US012065903B1

(12) United States Patent
Boyd et al.

(10) Patent No.: US 12,065,903 B1
(45) Date of Patent: Aug. 20, 2024

(54) CHOKE MECHANISM FOR A PLUNGER CATCHER

(71) Applicant: FLOWCO PRODUCTION SOLUTIONS, LLC, Spring, TX (US)

(72) Inventors: Garrett S. Boyd, Granbury, TX (US); Darrell Mitchum, Oakhurst, TX (US)

(73) Assignee: FLOWCO PRODUCTION SOLUTIONS, LLC, Spring, TX (US)

( * ) Notice: Subject to any disclaimer, the term of this patent is extended or adjusted under 35 U.S.C. 154(b) by 0 days.

(21) Appl. No.: 18/128,784

(22) Filed: Mar. 30, 2023

(51) Int. Cl.
*E21B 34/02* (2006.01)
*E21B 34/14* (2006.01)

(52) U.S. Cl.
CPC ..... *E21B 34/025* (2020.05); *E21B 34/142* (2020.05)

(58) Field of Classification Search
CPC ..... E21B 34/02; E21B 34/025; E21B 34/14; E21B 34/142; E21B 43/121
See application file for complete search history.

(56) References Cited

U.S. PATENT DOCUMENTS 11,208,874 B2 12/2021 Murdoch
2022/0349280 A1* 11/2022 Brewer ..... E21B 34/02

FOREIGN PATENT DOCUMENTS

CN 107701141 A * 2/2018 ..... E21B 33/03

* cited by examiner

*Primary Examiner* — Matthew R Buck
(74) *Attorney, Agent, or Firm* — FisherBroyles, LLP; Jason P. Mueller

(57) ABSTRACT

A lubricator and plunger catcher used in conjunction with an oil or gas well includes a manifold positioned between the wellhead and the plunger catcher. The manifold includes a plunger passageway that extends from the bottom of the manifold to the top of the manifold, with the plunger catcher being mounted to the top of the manifold. The manifold also includes a production passageway through which oil or gas leaving the wellhead is routed. A choke mechanism for at least partially blocking the production passageway is provided on the manifold to selectively vary the volume of the oil or gas leaving the wellhead that is routed through the plunger catcher. This, in turn, can selectively vary a force imparted to a plunger by the oil or gas leaving the wellhead to ensure the plunger is fully seated in the catcher when it arrives at the wellhead.

16 Claims, 10 Drawing Sheets

CHOKE MECHANISM FOR A PLUNGER CATCHER

BACKGROUND OF THE INVENTION

The present disclosure relates to a plunger catcher mechanism that receive, holds and releases a plunger used in oil and gas wells. More specifically, the present disclosure relates to a choke mechanism that can be used to ensure that when a plunger arrives at a wellhead, the plunger is fully seated in the catcher mechanism.

BRIEF DESCRIPTION OF THE DRAWINGS

The accompanying drawings are part of the present disclosure and are incorporated into the specification. The drawings illustrate examples of embodiments of the disclosure and, in conjunction with the description and claims, serve to explain various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein.

DETAILED DESCRIPTION OF THE INVENTION

Figure 1:
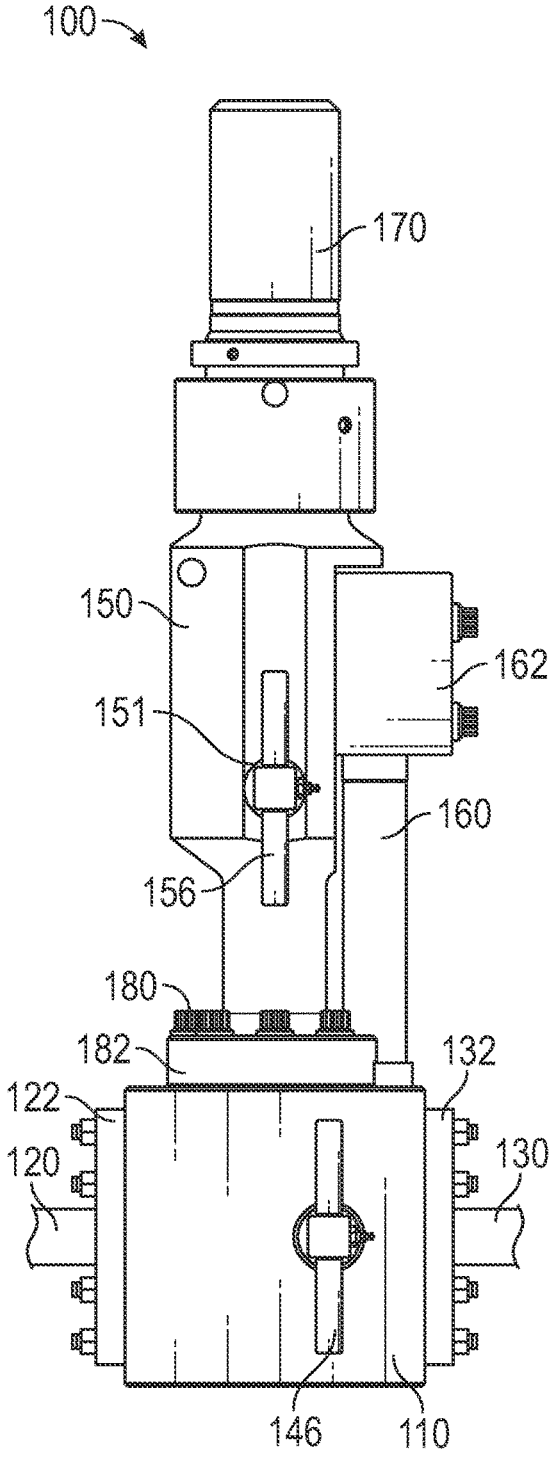
FIG. 1 is a front view of a manifold and plunger catcher assembly that includes a manually operated choke mechanism.
Figure 2:
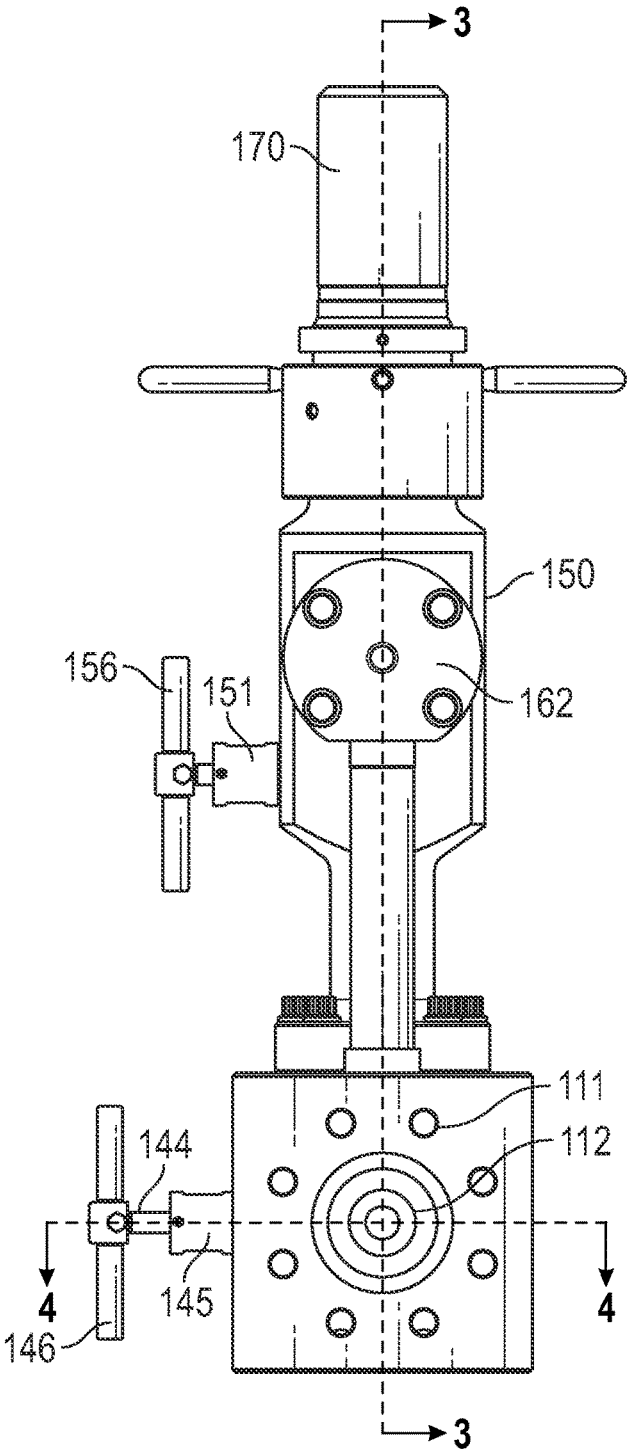
FIG. 2 is a right-side view of the manifold and plunger catcher assembly illustrated in FIG. 1.

The present disclosure is concerned with plunger catcher mechanism that is configured to hold and release a plunger used in oil and gas wells. As is well known to those of skill in the art, a manifold can be mounted on top of an oil or gas well, and a plunger catcher mechanism is then mounted on top of the manifold. Oil or gas produced by the well is routed through the manifold to a production line that typically leads to a collection tank.

When the downhole pressure of an oil or gas well is no longer high enough to force oil to gas to the surface at a satisfactory flow rate, one can employ a plunger to help bring oil or gas to the surface. A plunger is a device that is configured to freely descend and ascend within a well bore. The plunger operates to restore production to a well having insufficient pressure to lift the fluids to the surface. Some embodiments are configured as a "bypass" plunger, which may include a self-contained valve—also called a "dart" or a "dart valve"- to control the descent and ascent. Typically the valve is opened to permit fluids in the well to flow through the valve and passages in the plunger body as the plunger descends through the well. Upon reaching the bottom of the well, the valve is closed, converting the plunger into a piston by blocking the passages that allow fluids to flow through the plunger. With the plunger converted to a piston, blocking the upward flow of fluids or gas, pressure in the fluid below the bypass plunger gradually increases until the pressure is sufficient to lift the plunger and the column of fluid in the well bore located above the bypass plunger to the surface. As fluid above the bypass plunger arrives at the surface, the fluid is routed by the manifold to a production line. While the above description applies to bypass plungers, other types of plungers can also be used to help restore production to an oil or gas well.

When a plunger arrives at the surface, it passes through the manifold and into a plunger catcher mounted on top of the manifold. FIGS. 1-4 illustrate an example of a manifold and plunger catcher mechanism.

As illustrated in FIGS. 1-4, a manifold 110 is attached to the top of a well bore such that a plunger passageway 116 running from the bottom of the manifold 110 to the top of the manifold 110 is aligned with the well bore. While a plunger is ascending the well bore, pushing a column of fluid upward, the fluid is routed through the manifold 110 to a production passageway 118 that leads to a production outlet aperture 112 on a sidewall of the manifold 110. A production outlet line 130 is coupled to the sidewall of the manifold 110 by a production fixture 132. The fluid leaving the well bore is routed through the production outlet line 130 to a collection tank (not shown).

Figure 3A:
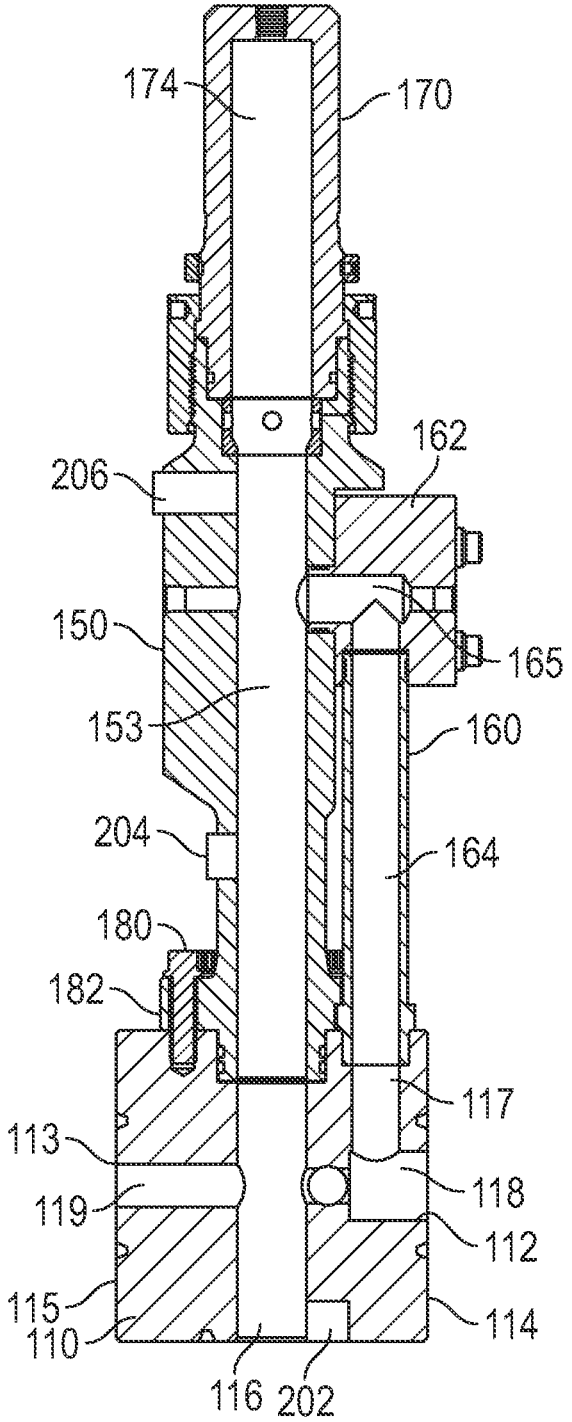
FIG. 3A is a cross-sectional view of the manifold and plunger catcher assembly illustrated in FIGS. 1 and 2 taken along section line 3-3 in FIG. 2 when no plunger is present in the plunger catcher.

As illustrated in FIG. 3A, an instrumentation passageway 119 in the manifold 110 leads to an instrumentation outlet aperture 113 on another sidewall of the manifold 110. As illustrated in FIG. 1, an instrumentation outlet line 120 is coupled to the sidewall of the manifold 110 by an instrumentation fixture 122. Fluid leaving the well bore can be routed to various sensors or instruments via the instrumentation outlet line 120.

As illustrated in FIG. 3A, fluid leaving the well bore can also be routed through the plunger passageway 118 to a hollow receiving bore 153 of the plunger catcher 150. The plunger catcher 150 is mounted on top of the manifold 110 by a catcher flange 182 and bolts 180. Fluid entering the hollow receiving bore 153 can then travel into an internal passageway 165 of a return line fixture 162 that is mounted onto a side of the plunger catcher 150. The fluid then travels down the interior passageway 164 of a return line 160 and into a return passageway 117 that is provided inside the manifold 110. The fluid then joins with fluid in the production passageway 118, which is routed into the production outlet line 130.

Fluid exiting the well bore is deliberately provided with this return circuit so that as a plunger leaves the well bore, passes through the manifold 110 and then travels up into the hollow receiving bore 153 of the plunger catcher 150, the fluid located above the plunger will be able to travel through the return circuit and into the production outlet line 130. If the return circuit were not provided, there would be nowhere for the fluid above the plunger to go, which would mean the plunger would be prevented from entering the hollow receiving bore 153 of the plunger catcher 150. In addition, by ensuring that there is a steady flow of fluid through this return circuit, the momentum of the fluid combined with the upward momentum of the plunger itself ensures that the plunger travels all the way up into the plunger catcher 150.

A holder mechanism 151 of the plunger catcher 150 is used to hold and release a plunger that travels up into the plunger catcher 150. A handle 156 of the holder mechanism 151 could be used to manually operate or adjust the plunger holder 151.

Figure 3B:
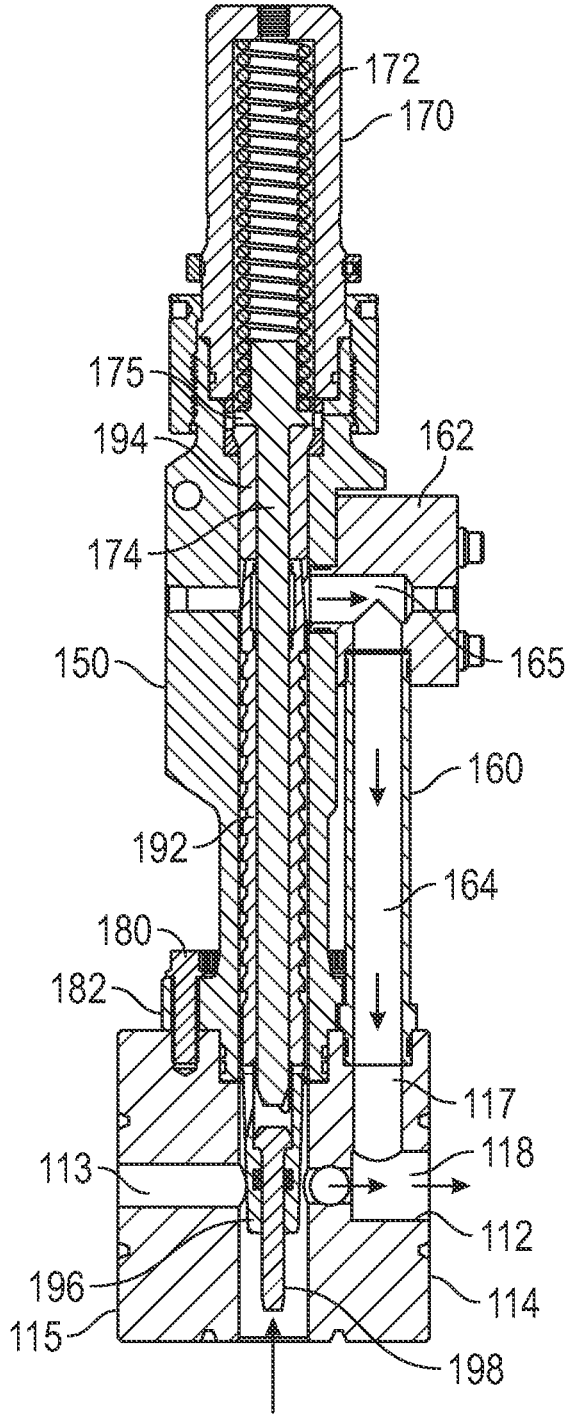
FIG. 3B is a cross-sectional view of the manifold and plunger catcher assembly illustrated in FIGS. 1 and 2 taken along section line 3-3 in FIG. 2 with a plunger located in the plunger catcher.

FIG. 3B illustrates a plunger 192 after it has been fully seated in the plunger catcher 150. The plunger 192 illustrated in FIG. 3B is a bypass plunger. However, the technology disclosed herein could be used in conjunction with any sort of plunger.

As illustrated in FIG. 3A, an arrival bumper spring 172 is mounted in the lubricator spring housing 170 of the plunger catcher 150. A shoulder 175 of a reset rod 174 bears against the lower part of the arrival bumper spring 172. The reset rod 174 extends downward into the hollow receiving bore 153 of the plunger catcher 150. As the plunger 192 moves upward into the hollow receiving bore 153 of the plunger catcher 150, the lower end of the reset rod 174 enters the hollow interior of the plunger 192. Further upward movement of the plunger 192 results in the reset rod extending deeper into the interior of the plunger 192 until the lower end of the reset rod 174 hits the top of a valve dart 198, pushing the valve dart 198 downward to a reset position. Once the valve dart 198 has been pushed into the reset position, fluid can travel through the interior of the plunger 192, which allows the plunger 192 to descend back to the bottom of the well bore.

As the upper end 194 of the plunger 192 arrives at the top of its travel, the upper end 194 of the plunger 192 hits the shoulder 175 of the reset rod 174. The shoulder 175 of the reset rod 174 bears against the lower end of the arrival bumper spring 172. The arrival bumper spring 172 operates to help arrest upward movement of the plunger 192 in a controlled matter, limiting any potential damage to the plunger 192 or the plunger catcher 150 due to the impact of the plunger 192 when it arrives and stops inside the plunger catcher 150.

In a well that has little pressure, which is the type of well where plungers are employed, the upward flow of the fluid may not be sufficient to cause the plunger 192 to move upward enough to fully seat in the plunger catcher 150. This can result in a stuck condition, where the plunger 192 blocks the flow of fluid out of the production passageway 118 of the manifold. Also, because the plunger 192 does not travel sufficiently far enough upward into the plunger catcher 150, the reset rod 174 cannot operate to push the valve dart 198 into the reset position. As a result, the passageways through the interior of the plunger 192 are not opened and the plunger 192 cannot travel back down to the bottom of the well bore.

The present application discloses a choke mechanism that is mounted on the manifold 110 and which operates to increase the flow rate of fluid through the return circuit that travels through the hollow receiving bore 153 and return line 160 of the plunger catcher 150. The increased the flow rate of fluid through this return circuit helps to preserve the upward momentum of the plunger 192 when it arrives at the top of the well bore, thereby helping the plunger 192 to move fully upward into the plunger catcher 150.

Figure 4:
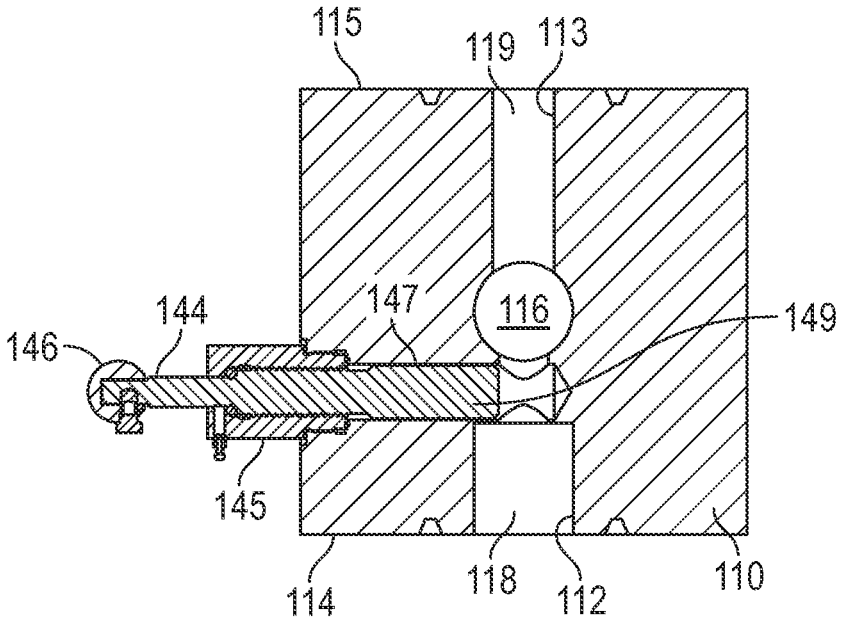
FIG. 4 is a cross-sectional view of the manifold of the manifold and plunger catcher assembly illustrated in FIGS. 1 and 3 taken along section line 4-4 in FIG. 2.
Figure 5:
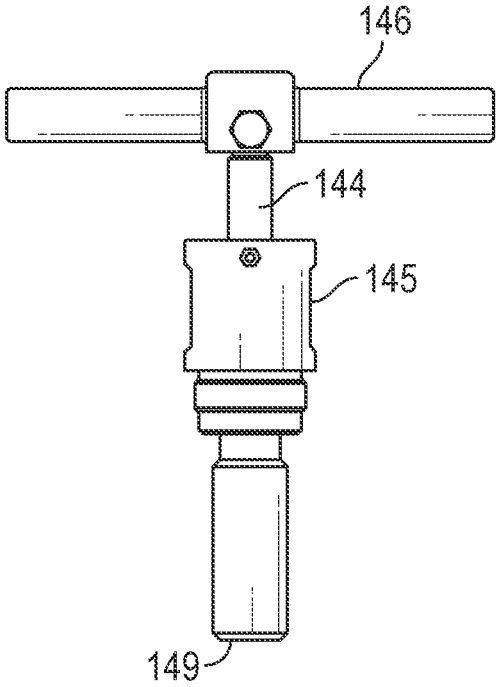
FIG. 5 illustrates a manually operated actuator of a choke assembly of the manifold of the manifold and plunger catcher assembly illustrated in FIGS. 1 and 2.
Figure 6:
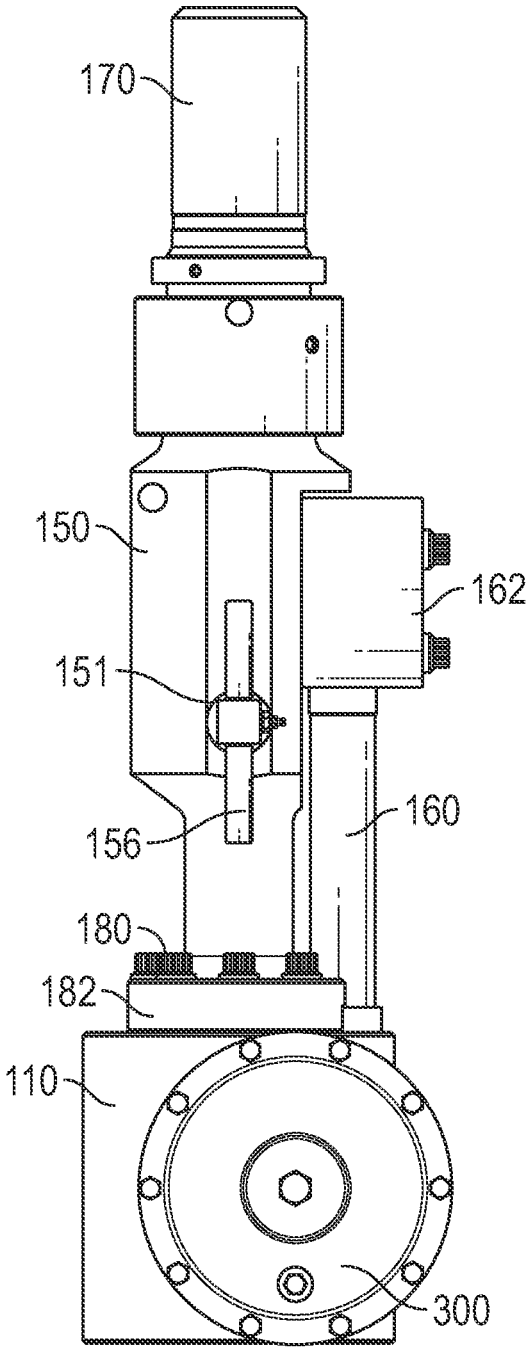
FIG. 6 is a front view of a manifold and plunger catcher mechanism that includes a pneumatic or hydraulically operated choke mechanism.
Figure 7:
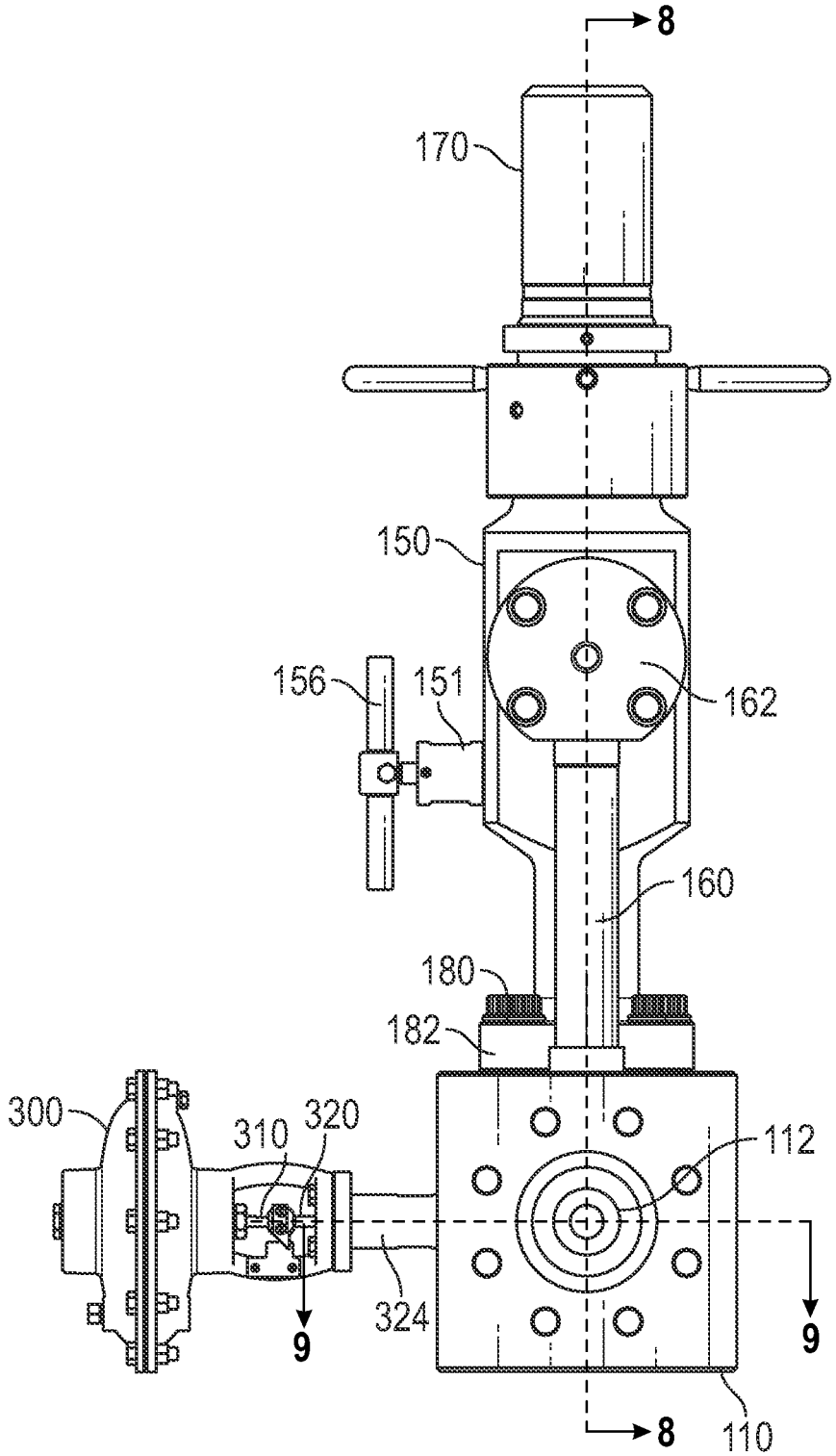
FIG. 7 is a right-side view of the manifold and plunger catcher mechanism illustrated in FIG. 6.
Figure 8:
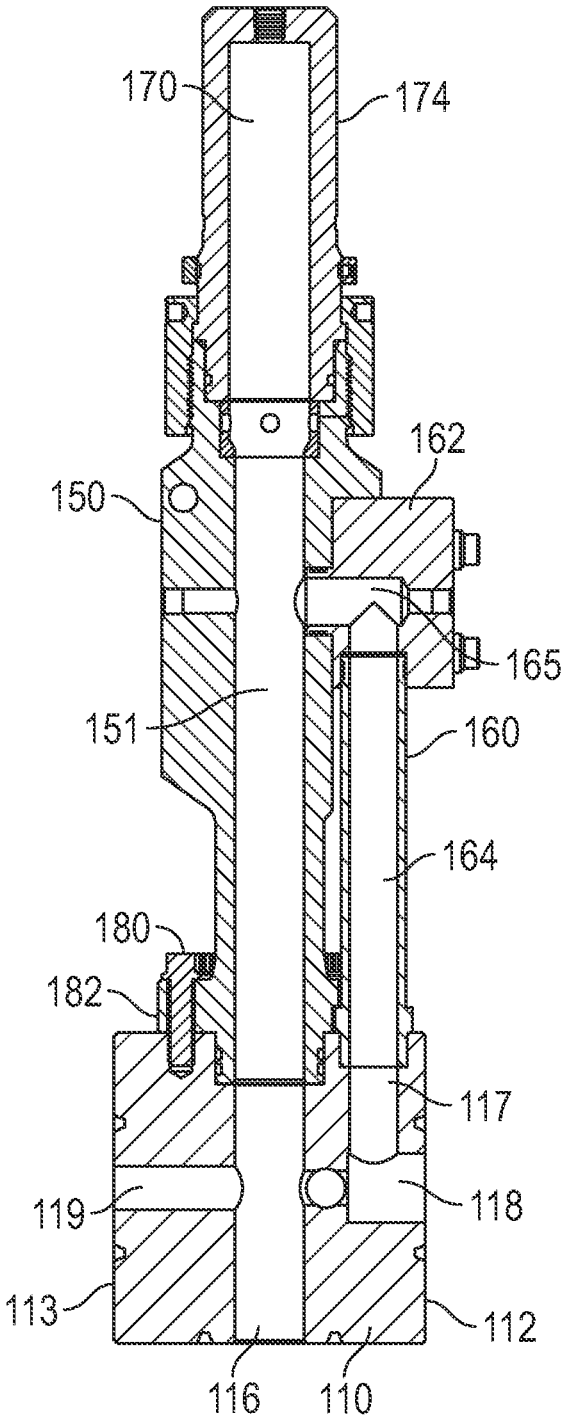
FIG. 8 is a cross-sectional view of the manifold and plunger catcher mechanism illustrated in FIGS. 6 and 7 taken along section line 8-8 in FIG. 7.

In a first embodiment as illustrated in FIGS. 1-5, the choke mechanism includes a choke member 147 that is slidably mounted in a choke passageway 113 of the manifold 110. As illustrated in FIGS. 3A, 3B and 4, the choke passageway 113 communicates with the production passageway 118 of the manifold 110. A choke mount collar 145 is mounted to the exterior of the manifold, and internal threads on the choke mount collar 145 engage external threads on a middle portion of the choke member 147. A handle 146 is attached to a proximal end 144 of the choke member 147. By turning the handle 146 clockwise and counterclockwise, one can cause the choke member 147 to rotate, and the internal threads on the choke mount collar 145 and external threads on the choke member 147 convert rotational motion of the chock member into axial movement of the choke member 147 along the chock passageway 113 of the manifold 110. This allows one to cause the distal end 149 of the choke member 147 to protrude into the production passageway 118 of the manifold 110.

When the distal end 149 of the choke member 147 protrudes into the production passageway 118, partially blocking the production passageway 118, more of the fluid exiting the well bore is routed through the return circuit that passes through the plunger catcher 150. As perhaps best seen in FIGS. 3A and 3B, fluid leaving the return circuit and arriving back at the manifold 110 will enter the production passageway 118 on the downstream side of the distal end 149 of the choke member 147. Thus, by selectively advancing and withdrawing the distal end 149 of the choke member 147 into and out of the production passageway 118, one can selectively vary the flow rate of fluid leaving the well bore that is routed through the return circuit passing through the plunger catcher 150.

If the flow rate of fluid leaving the well bore is not sufficient to cause a plunger to fully seat in the plunger catcher 150, one can advance the distal end 149 of the choke member 147 into the production passageway 118, thereby partially blocking the production passageway 118. This serves to increase the flow rate of fluid through the return circuit, which helps to ensure that the plunger will travel fully up into the plunger catcher 150. If pressure in the well increases such that the normal flow rate of fluid leaving the well bore is sufficient to cause the plunger to fully seat in the plunger catcher 150, the choke member 147 can be fully withdrawn from the production passageway 118, which helps to maximize flow out of the well into a collection tank.

The manifold 110 and/or the plunger catcher 150 may include one or more sensors that are used to determine the location and movements of a plunger. For example, an arrival sensor 202 may be mounted on the manifold 110. The arrival sensor 202 would output an arrival signal when a plunger emerges from the well bore and passes into the plunger passageway 116 of the manifold 110. Likewise, an arrival sensor 204 may be provided on the plunger catcher 150. The arrival sensor 204 on the plunger catcher 150 outputs an arrival signal when a plunger is located partway in the hollow receiving bore 153. Further, a seated sensor 206 could be located near the upper end of the hollow receiving bore 153 of the plunger catcher. The seated sensor 206 outputs a seated signal when a plunger is fully seated in the plunger catcher 150.

A controller coupled to the arrival sensors 202, 204 and the seated sensor 206 could determine whether a plunger is not fully seating in the plunger catcher 150 upon arriving at the surface. For example, if the controller notes that the seated sensor 206 did not output a seated signal shortly after one or both of the arrival sensors 202, 204 output an arrival signal, this would likely mean that the flow rate of fluid out of the well head and through the return circuit passing through the plunger catcher 150 was not sufficient to carry the plunger up into a fully seated position within the plunger catcher 150. This would be an indicate that the choke mechanism should be reset to advance the distal end 149 of the choke member 147 further into the production passageway 118 of the manifold 110 to increase the flow rate of fluid through the return circuit passing through the plunger catcher 150.

Figure 9:
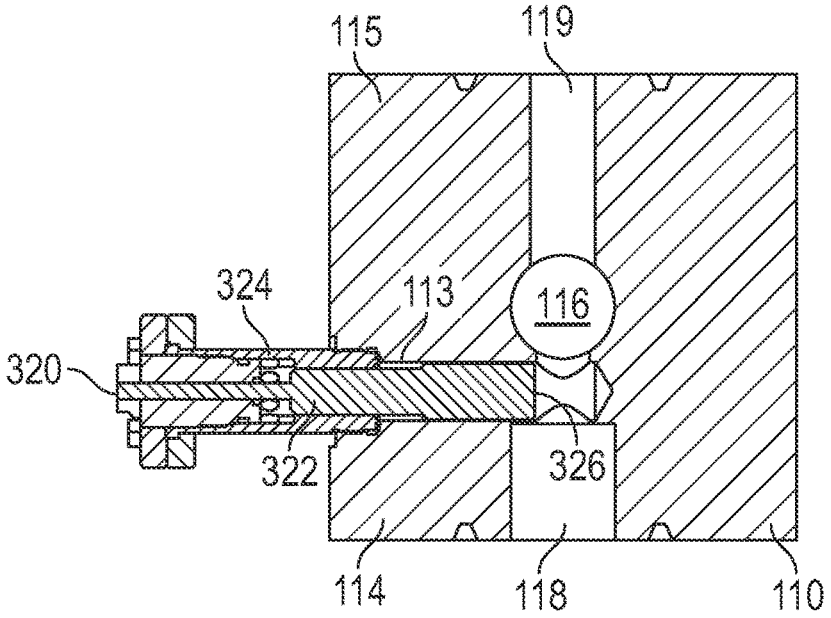
FIG. 9 is a partial cross-sectional view of the manifold of the manifold and plunger catcher mechanism illustrated in FIGS. 6 and 7 taken along section line 9-9 in FIG. 7.
Figure 10:
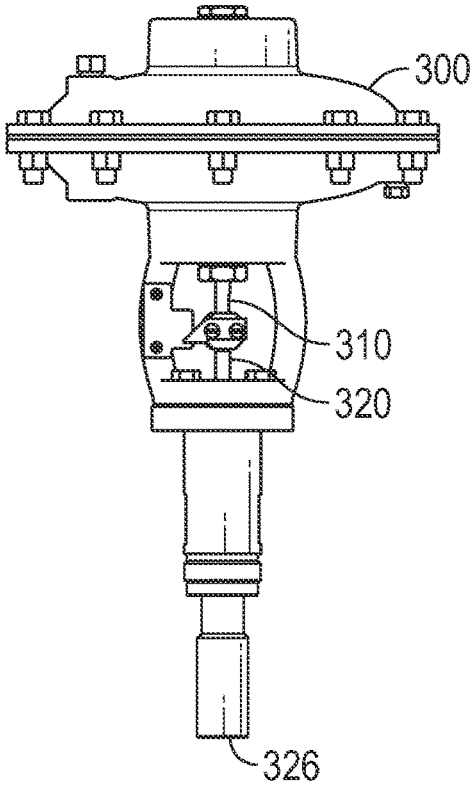
FIG. 10 is a top view of the pneumatic or hydraulic actuator of the manifold and plunger catcher mechanism illustrated in FIGS. 6 and 7.
Figure 11:
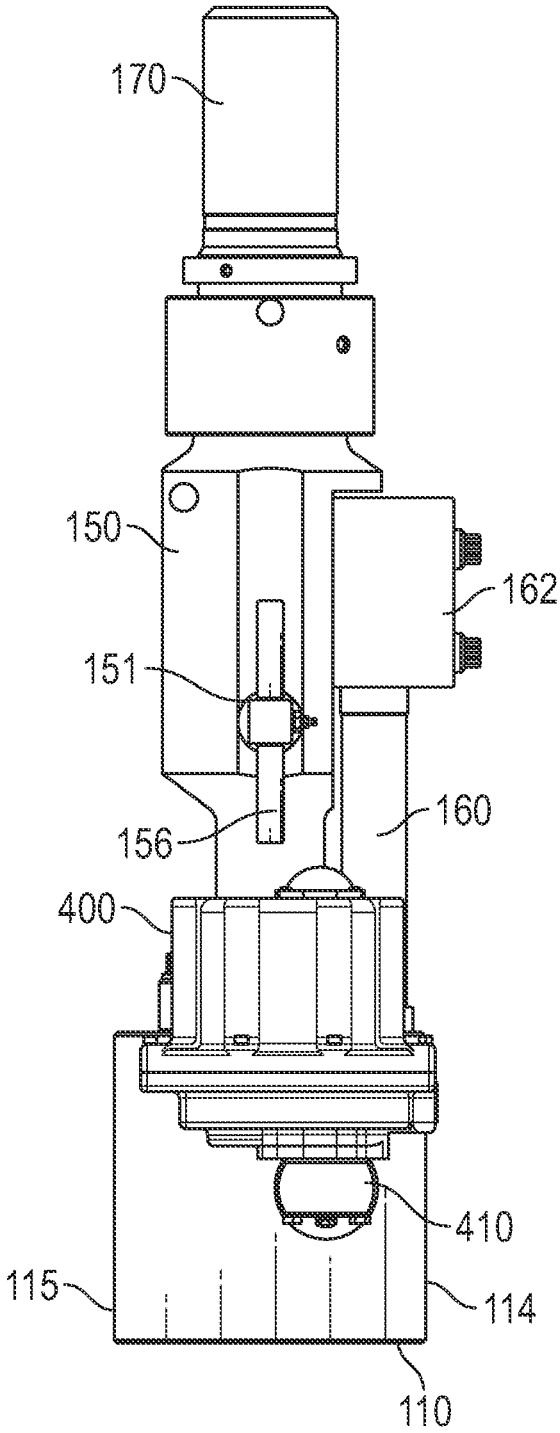
FIG. 11 is a front view of a manifold and plunger catcher mechanism with an electrically operated choke mechanism.
Figure 12:
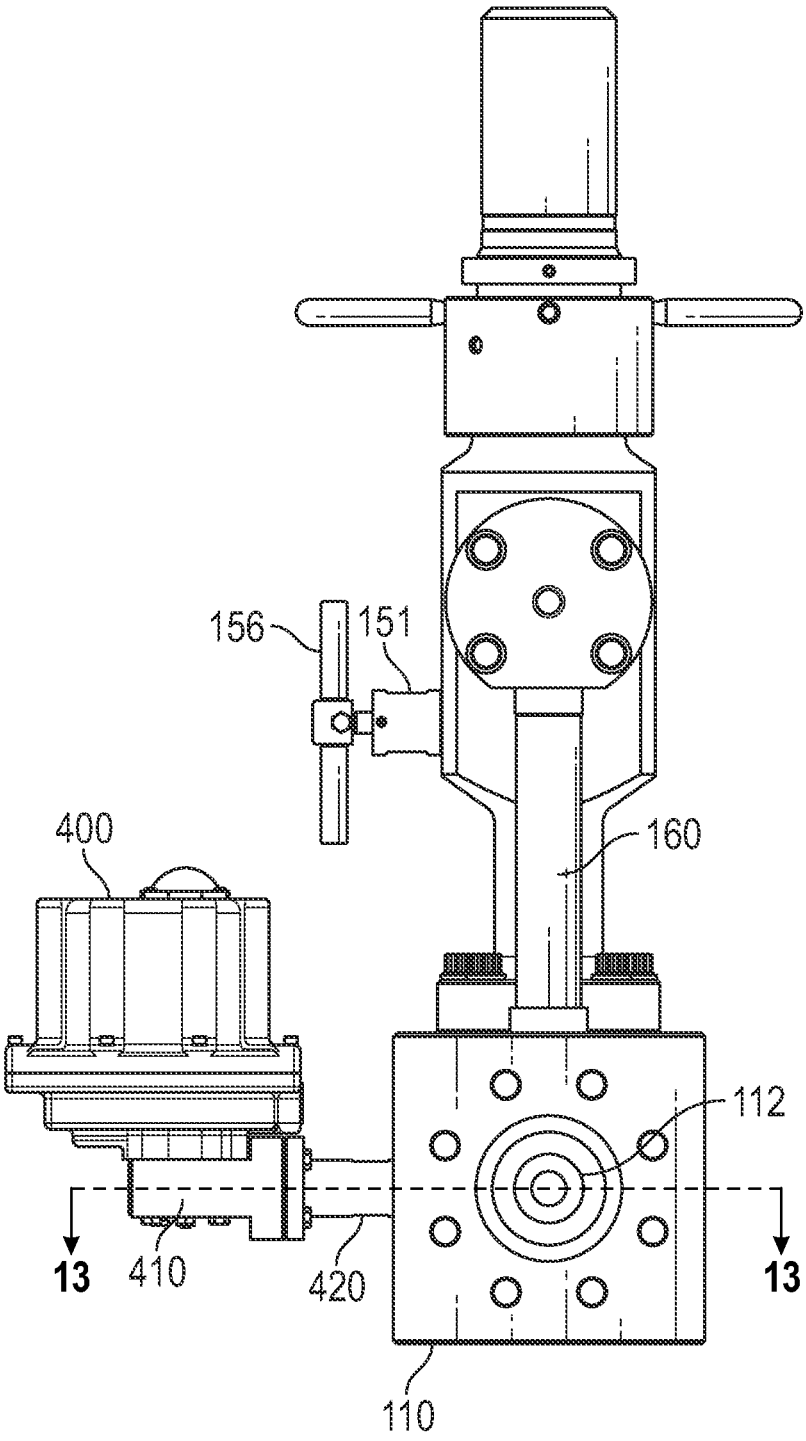
FIG. 12 is a right-side view of the manifold and plunger catcher mechanism illustrated in FIG. 11.
Figure 13:
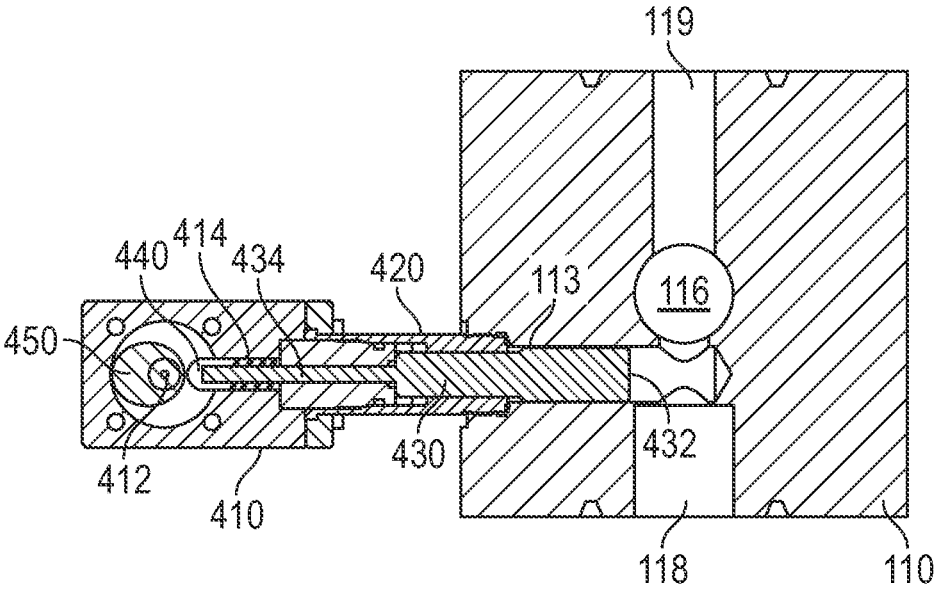
FIG. 13 is a partial cross-sectional view of the manifold of the manifold and plunger catcher mechanism illustrated in FIGS. 11 and 12 taken along section line 13-13 in FIG. 12.
Figure 14:
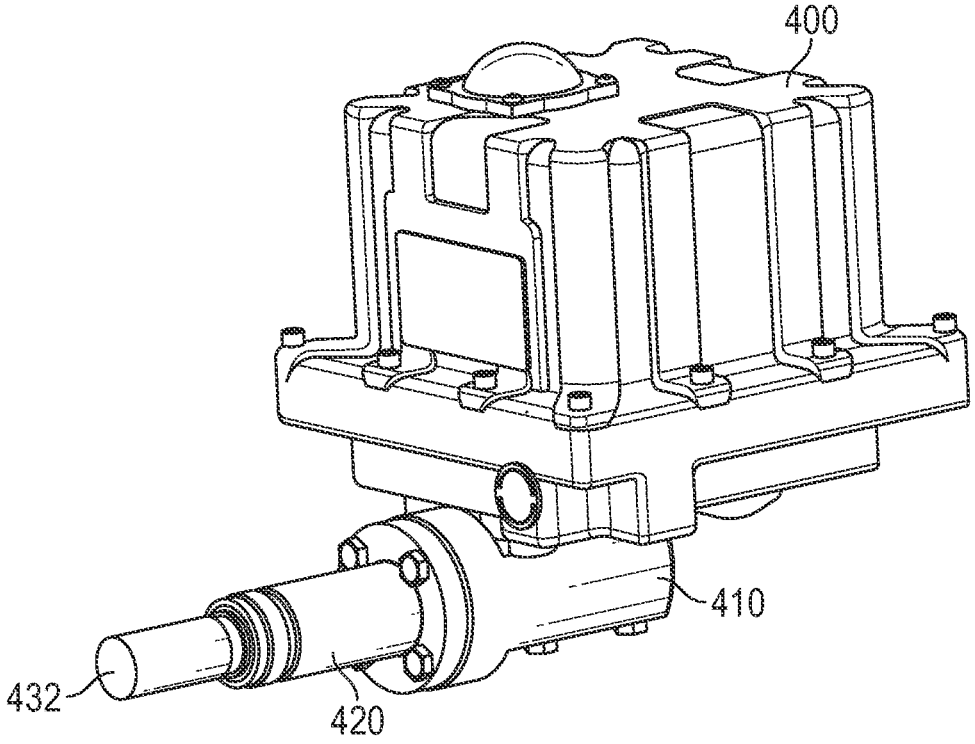
FIG. 14 is a perspective view of the electrically operated choke mechanism of the manifold and plunger catcher mechanism illustrated in FIGS. 11 and 12.

FIGS. 7-10 illustrate an alternate embodiment in which the manually operated choke mechanism illustrated in FIGS. 1-5 is replaced with a choke mechanism that is operated by a pneumatic or hydraulic actuator 300. As illustrated in FIG. 9, the choke mechanism still includes a choke member 322 slidably mounted in the choke passageway 113 of the manifold 110. A choke mount collar 324 is mounted to the exterior sidewall of the manifold 110. A proximal end 320 of the choke member 322 extends from the choke mount collar 324. The proximal end 320 of the choke member 322 is coupled to an actuator member 310 of the pneumatic/hydraulic actuator mechanism 300. The pneumatic/hydraulic actuator mechanism 300 can operate to cause the distal end 326 of the choke member 322 to extend into and retract from the production passageway 118 of the manifold 110 in essentially the same way as the first embodiment discussed above. Thus, pneumatic/hydraulic actuator 300 can be used to selectively vary the flow rate of fluid through the return circuit passing through the plunger catcher 150.

FIGS. 11-14 illustrate another embodiment that includes an electrically operated choke mechanism. In this embodiment, a choke mount collar 420 is mounted to a sidewall of the manifold 110, and a choke member 430 is slidably mounted in the choke mount collar 420 and the choke passageway 113 of the manifold 110. The distal end 432 of the choke member 430 can be advanced into and retracted from the production passageway 118 of the manifold 110 by the electrically operated actuator 400.

A proximal end 434 of the choke member 430 is covered by a cam follower 440. A return spring 414 urges the choke member 430 into a retracted position, and also serves to keep the cam follower 440 pressed against a rotatably mounted cam 450. The cam 450 is located in a cam housing 410 and the cam 450 is mounted onto a rotating shaft 412 of an electric motor of the electrically operated actuator 400. When the motor rotates the cam 450, the surface of the cam 450 pushes the cam follower 440 and the choke member 430 further into the manifold 110 so that the distal end 432 of the choke member 430 protrudes into the production passageway 118 of the manifold 110. Thus, selectively operating the motor of the electrically operated actuator 400 allows one to control the extent to which the distal end 432 of the choke member 430 blocks the production passageway, and thus the flow rate of fluid through the return circuit passing through the plunger catcher 150.

In some embodiments, a controller coupled to an arrival sensor 202/204 and a seated sensor 206 could be used to automatically adjust the position of the choke member. If the controller does not receive a seated signal from the seated sensor 206 immediately after receiving an arrival signal from an arrival sensor 202, 204, this would indicate that the flow rate of fluid through the return circuit passing through the plunger catcher 150 was not sufficient to cause the plunger to fully seat in the plunger catcher 150. Under those conditions, the controller could send a signal to an actuator of a choke mechanism to cause a distal end of a choke member to protrude further into the production passageway 118 of the manifold 110. This would serve to increase the flow rate of fluid through the return passageway, thereby aiding the plunger in fully seating in the plunger catcher 150.

Conditional language, such as, "can," "could," "might," or "may," unless specifically stated otherwise, or otherwise understood within the context as used, is generally intended to convey that certain implementations could, but do not necessarily, include certain features and/or elements while other implementations may not. Thus, such conditional language generally is not intended to imply that features and/or elements are in any way required for one or more implementations or that one or more implementations necessarily include these features and/or elements. It is also intended that, unless expressly stated, the features and/or elements presented in certain implementations may be used in combination with other features and/or elements disclosed herein.

The specification and annexed drawings disclose example embodiments of the present disclosure. Detail features shown in the drawings may be enlarged herein to more clearly depict the feature. Thus, several of the drawings are not precisely to scale. Additionally, the examples illustrate various features of the disclosure, but those of ordinary skill in the art will recognize that many further combinations and permutations of the disclosed features are possible. Accordingly, various modifications may be made to the disclosure without departing from the scope or spirit thereof. Further, other embodiments may be apparent from the specification and annexed drawings, and practice of disclosed embodiments as presented herein. Examples disclosed in the specification and the annexed drawings should be considered, in all respects, as illustrative and not limiting. Although specific terms are employed herein, they are used in a generic and descriptive sense only, and not intended to the limit the present disclosure.

What is claimed is:

1. A choke mechanism for a plunger catcher of an oil or gas well, comprising:

a manifold configured to be coupled to a wellhead, the manifold comprising:

a plunger passageway that extends straight through the manifold from a bottom of the manifold to a top of the manifold, a production passageway that extends from the plunger passageway to a production outlet aperture on an exterior sidewall of the manifold, and a choke passageway that communicates with the production passageway; and a choke mechanism that is mounted on the manifold and that includes:

a choke member configured to move along the choke passageway; and an actuator coupled to the choke member and configured to selectively vary an extent to which a distal end of the choke member extends into the production passageway and blocks the production passageway.

2. The choke mechanism of claim 1, wherein the actuator is configured to be manually operated by a user.

3. The choke mechanism of claim 1, wherein the actuator is configured to be operated by an electrical drive signal.

4. The choke mechanism of claim 3, wherein the actuator comprises an electrical motor and a rotatable cam coupled to a rotating shaft of the electrical motor, wherein the cam bears against a proximal end of the choke member and wherein rotation of the cam causes the choke member to move along the choke passageway.

5. The choke mechanism of claim 1, wherein the actuator is configured to be operated by a pressurized gas or fluid.

6. The choke mechanism of claim 1, further comprising a controller that is operatively coupled to the actuator, wherein the controller is configured to operate the actuator to selectively vary the extent to which the distal end of the choke member blocks the production passageway.

7. The choke mechanism of claim 1, wherein the production outlet aperture is located on a first sidewall of the manifold and wherein the choke passageway opens to a choke aperture located on an exterior wall of the manifold other than the first sidewall.

8. The choke mechanism of claim 7, wherein the actuator is mounted to the choke aperture or to the exterior wall of the manifold in which the choke aperture is located.

9. A method of operating a plunger catcher mounted on a wellhead, wherein the plunger catcher includes:

a manifold configured to be coupled to the wellhead, the manifold comprising:

a plunger passageway that extends straight through the manifold from a bottom of the manifold to a top of the manifold, a production passageway that extends from the plunger passageway to a production outlet aperture on an exterior sidewall of the manifold, and a choke passageway that communicates with the production passageway; and a choke mechanism that is mounted on the manifold and that includes a choke member configured to move along the choke passageway, wherein the choke mechanism is configured to cause a distal end of the choke member to extend into the production passageway to at least partially block the production passageway;

the method comprising:

operating the choke mechanism to locate the choke member at a first position in the choke passageway;

determining whether a plunger fully seats in the plunger catcher when the plunger arrives at the wellhead; and operating the choke mechanism to locate the choke member at a second position in which a distal end of the choke member extends a greater distance into the production passageway than when the choke member was located at the first position when the determining step indicates that the plunger did not fully seat in the plunger catcher when the plunger arrived at the wellhead.

10. The method of claim 9, wherein the plunger catcher further includes an arrival sensor that generates an arrival signal when a plunger arrives at the wellhead and a seated sensor that generates a seated signal when the plunger fully seats in the plunger catcher after arriving at the wellhead, and wherein the step of determining whether a plunger fully seats in the plunger catcher comprises determining that the seated sensor did not generate a seated signal after the arrival sensor generated an arrival signal.

11. A plunger catcher for an oil or gas well, comprising:

a manifold configured to be coupled to a wellhead, the manifold comprising:

a plunger passageway that extends straight through the manifold from a bottom of the manifold to a top of the manifold, a production passageway that extends from the plunger passageway to a production outlet aperture on an exterior of the manifold, and a choke passageway that communicates with the production passageway; and a choke mechanism that is mounted on the manifold and that includes:

a choke member configured to move along the choke passageway; and an actuator coupled to the choke member and configured to selectively vary an extent to which a distal end of the choke member extends into the production passageway and blocks the production passageway;

a hollow receiving bore coupled to the top of the manifold that communicates with the plunger passageway, wherein the hollow receiving bore is configured to receive a plunger when the plunger arrives at the wellhead.

12. The plunger catcher of claim 11, wherein the actuator can be manually operated by a user.

13. The plunger catcher of claim 11, wherein the actuator is electrically operated.

14. The plunger catcher of claim 11, wherein the actuator is operated by a pressurized gas or fluid.

15. The plunger catcher of claim 11, further comprising:

an arrival sensor that generates an arrival signal when a plunger arrives at the wellhead;

a seated sensor that generates a seated signal when the plunger fully seats in the receiving bore after arriving at the wellhead; and a controller operatively coupled to the choke mechanism actuator, the arrival sensor and the seated sensor, wherein the controller is configured to cause the actuator to adjust a position of the choke member such that the plunger fully seats in the receiving bore after arriving at the wellhead.

16. The plunger catcher of claim 15, wherein when the controller fails to receive a seated signal from the seated sensor after receiving an arrival signal from the arrival sensor, the controller causes the actuator to move the choke member from a first position in the choke passageway to a second position in the choke passageway at which the distal end of the choke member blocks a greater amount of the production passageway than when the choke member was located in the first position.

* * * * *